US010072365B2

(12) United States Patent
Birk et al.

(10) Patent No.: US 10,072,365 B2
(45) Date of Patent: Sep. 11, 2018

(54) KNIT FABRICS AND BASE LAYER GARMENTS MADE THEREFROM WITH IMPROVED THERMAL PROTECTIVE PROPERTIES

(75) Inventors: Sharon W. Birk, Wilmington, DE (US); Yashavant Vinayak Vinod, Hockessin, DE (US); Douglas A. Bloom, Seaford, DE (US); Fred C. Wynegar, Wilmington, DE (US)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 236 days.

(21) Appl. No.: 12/173,648

(22) Filed: Jul. 15, 2008

(65) Prior Publication Data

US 2009/0019624 A1 Jan. 22, 2009

Related U.S. Application Data

(60) Provisional application No. 60/950,242, filed on Jul. 17, 2007.

(51) Int. Cl.
*D04B 1/14* (2006.01)
*D02G 3/04* (2006.01)
(Continued)

(52) U.S. Cl.
CPC ..... *D04B 1/14* (2013.01); *A41D 31/0022* (2013.01); *D02G 3/04* (2013.01); *D02G 3/443* (2013.01);
(Continued)

(58) Field of Classification Search
CPC . D04B 1/14; D04B 1/16; D04B 21/16; D04B 21/04; D04B 21/08
(Continued)

(56) References Cited

U.S. PATENT DOCUMENTS 3,044,250 A 7/1962 Hebeler
3,188,790 A 6/1965 Hebeler
(Continued)

FOREIGN PATENT DOCUMENTS

FR 2466517 10/1980
JP 54-151669 11/1979
(Continued)

OTHER PUBLICATIONS

Transactions New York Academy of Sciences, 1971, 33, p. 649—Alice M. Stoll and Maria A. Chianta.
(Continued)

*Primary Examiner* — Danny Worrell
(74) *Attorney, Agent, or Firm* — Licata & Tyrrell P.C.; Robert B. Furr

(57) ABSTRACT

Knit fabrics and military apparel such as T-shirts made therefrom are disclosed. The fabrics are constructed from blended yarns made from an intimate combination of nylon and cotton staple fibers. Such fabrics comprise a weight ratio of cotton to nylon which ranges from about 55:45 to about 85:15, and these fabrics also have a weight ranging from about 3 to about 8 oz/yd$^2$. Knit fabrics of this type possess a desirable combination of good thermal protective properties, provided the specified high level of staple fiber blend uniformity is achieved, along with very useful abrasion resistance, bursting strength and drying time characteristics.

29 Claims, 1 Drawing Sheet

(51) Int. Cl.
*D02G 3/44* (2006.01)
*A41D 31/00* (2006.01)

(52) U.S. Cl.
CPC ..... *A41D 2500/10* (2013.01); *D10B 2201/00* (2013.01); *D10B 2331/02* (2013.01); *D10B 2501/04* (2013.01); *Y10T 442/2172* (2015.04); *Y10T 442/2279* (2015.04); *Y10T 442/2484* (2015.04); *Y10T 442/2525* (2015.04); *Y10T 442/2541* (2015.04); *Y10T 442/2631* (2015.04); *Y10T 442/40* (2015.04); *Y10T 442/45* (2015.04)

(58) Field of Classification Search
USPC ..... 66/202, 169 R, 170, 190, 191; 442/318, 442/319, 136
See application file for complete search history.

(56) References Cited

U.S. PATENT DOCUMENTS

| | | | | |
|---|---|---|---|---|
| 3,321,448 | A | | 5/1967 | Hebeler |
| 3,459,845 | A | | 8/1969 | Hebeler |
| 4,035,542 | A | * | 7/1977 | Rosenthal et al. ..... 442/202 |
| 4,085,182 | A | | 4/1978 | Kato |
| 4,513,042 | A | | 4/1985 | Lumb |
| 4,525,410 | A | | 6/1985 | Hagiwara |
| 4,612,150 | A | | 9/1986 | De Howitt |
| 4,698,956 | A | * | 10/1987 | Clarke et al. ..... 57/2 |
| 4,732,789 | A | | 3/1988 | Hauser et al. |
| 4,750,911 | A | | 6/1988 | Hansen et al. |
| 4,812,144 | A | | 3/1989 | Hansen |
| 4,920,000 | A | * | 4/1990 | Green ..... 442/189 |
| 4,950,540 | A | * | 8/1990 | McCullough et al. ..... 428/369 |
| 4,997,712 | A | | 3/1991 | Lin |
| 5,011,645 | A | | 4/1991 | Thompson, Jr. |
| 5,180,402 | A | | 1/1993 | Kubota |
| 5,308,563 | A | | 5/1994 | Hodan |
| 5,468,545 | A | * | 11/1995 | Fleming et al. ..... 442/143 |
| 5,480,458 | A | * | 1/1996 | Fleming et al. ..... 427/393.3 |
| 5,876,849 | A | * | 3/1999 | Green ..... 428/359 |
| 5,888,194 | A | | 3/1999 | Utsumi et al. |
| 5,897,673 | A | | 4/1999 | Nishida |
| 5,984,708 | A | | 9/1999 | Langley |
| 6,547,835 | B1 | * | 4/2003 | Lunsford et al. ..... 8/531 |
| 6,626,964 | B1 | * | 9/2003 | Lunsford et al. ..... 442/136 |
| 6,766,817 | B2 | | 7/2004 | da Silva |
| 6,787,228 | B2 | * | 9/2004 | Campbell et al. ..... 428/365 |
| 6,805,957 | B1 | | 10/2004 | Santos |
| 6,918,404 | B2 | | 7/2005 | da Silva |
| 6,979,491 | B2 | | 12/2005 | Yan et al. |
| 7,065,950 | B2 | * | 6/2006 | Zhu et al. ..... 57/255 |
| 7,066,586 | B2 | | 6/2006 | da Silva |
| 7,168,140 | B2 | * | 1/2007 | McKee et al. ..... 28/167 |
| 7,713,891 | B1 | * | 5/2010 | Li et al. ..... 442/136 |
| 7,741,233 | B2 | * | 6/2010 | Sasser et al. ..... 442/136 |
| 2004/0060119 | A1 | * | 4/2004 | Murphy et al. ..... 5/698 |
| 2004/0192134 | A1 | * | 9/2004 | Gibson et al. ..... 442/167 |
| 2005/0025962 | A1 | | 2/2005 | Zhu |
| 2005/0025963 | A1 | * | 2/2005 | Zhu ..... 428/364 |
| 2005/0085145 | A1 | * | 4/2005 | Fang et al. ..... 442/95 |
| 2006/0292953 | A1 | * | 12/2006 | Ashley et al. ..... 442/197 |

FOREIGN PATENT DOCUMENTS

| | | |
|---|---|---|
| JP | 03-136649 | 6/1991 |
| WO | WO2006/088538 | 8/2006 |

OTHER PUBLICATIONS

Books & Journals / Journal of ASTM International (JAI) / Citation Page / vol. 2, Issue 2 (Feb. 2005).
Wool and Aramid [ Retrieved from the Internet: URL: http://www.designnews.com/blog/380000238/post/1830017583.html ].
Wickers(TM) Underwear [ Retrieved from the Internet: URL: http://underwear.wickers.com/Flame-Retardant-ZXcZX13 ].
Organic Cotton Underwear and Organic Cotton Socks [ Retrieved from the Internet: URL: http://www.mamasearth.com/mens_underwear.htm ].
Excel Jackets [ Retrieved from the Internet: URL: http://www.coverallsale.com/excel-jackets.htm ].
Indura® Ultra Soft® [ Retrieved from the Internet: URL: http://www.barrier-wear.com/about_barrierwear.asp.
Banwear [ Retrieved from the Internet: URL: http://www.banwear.com/Banwear.html ].

* cited by examiner

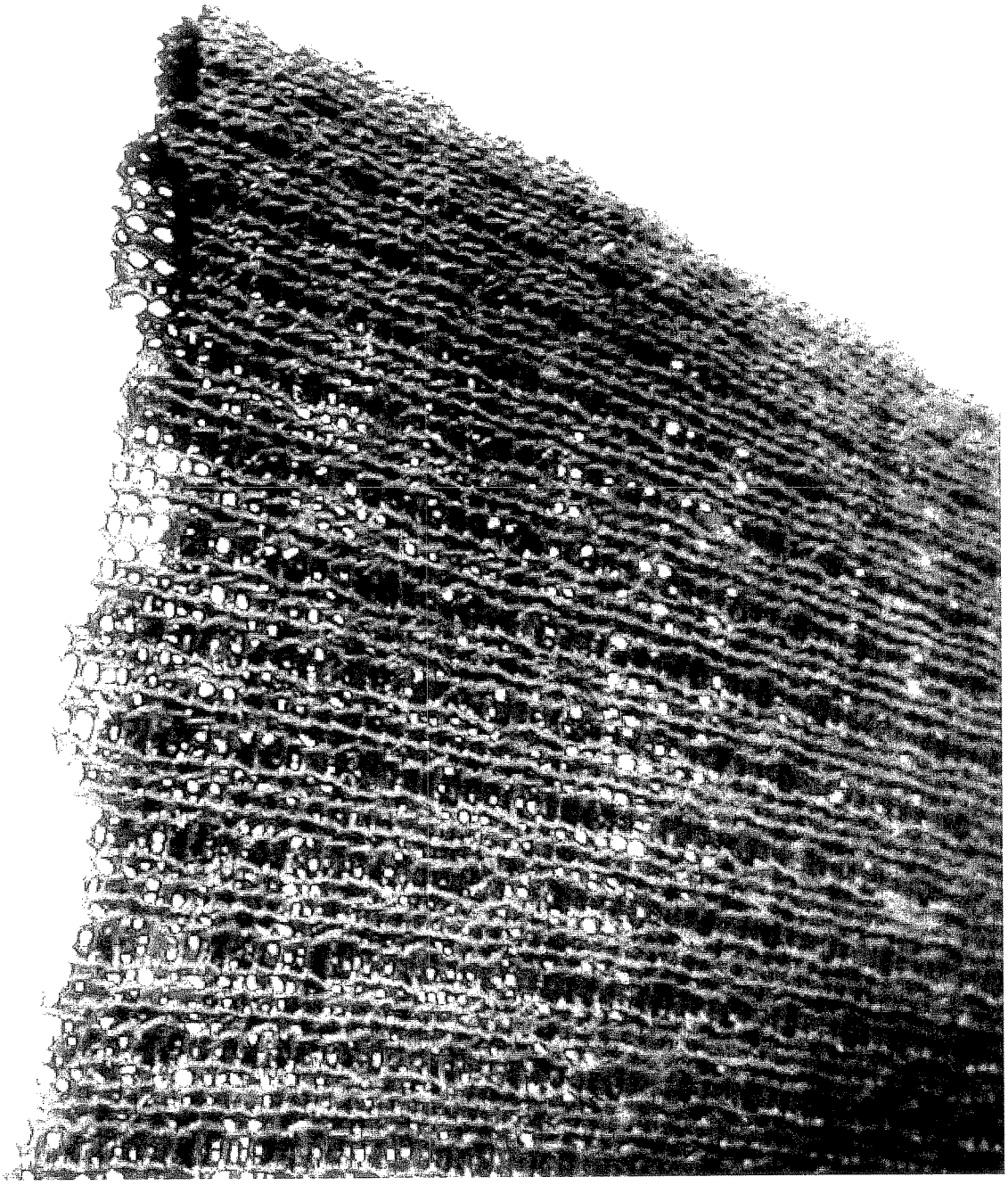

KNIT FABRICS AND BASE LAYER GARMENTS MADE THEREFROM WITH IMPROVED THERMAL PROTECTIVE PROPERTIES

FIELD OF THE INVENTION

The present invention relates to knitted fabrics and to base layer garments made from such fabrics. Such fabrics made from knit fabric constructions incorporate yarns fashioned from selected intimate blends of cellulosic and nylon staple fibers. Such knitted fabrics exhibit a very desirable combination of structural and thermal protective properties which makes such fabrics especially useful for preparing base layer apparel suitable for offering secondary protection against the threat of a flash fire or an electric arc.

BACKGROUND OF THE INVENTION

Protective apparel has special design and functional needs due to the wide variety of activities that the wearer is engaged in and the wide variety of threats due to the environments to which the wearer is exposed. Protective apparel should exhibit good breaking, tear and abrasion resistance for durability in rugged activities and terrain as well as moisture transport and breathability for reduced heat stress and comfort in hot climates and activities requiring high energy intensity. Additionally, the fabric used in protective apparel must be designed to provide the wearer a wide range of motion in order for the wearer to perform a variety of activities and should provide some environmental protection for the wearer against a variety of climatic conditions. Further, the fabric must be capable of being dyed for aesthetic purposes in most protective apparel and for camouflage purposes in military, tactical, and law enforcement applications. Finally, in applications where threat of thermal hazards exists, protective apparel such as base layers which are worn next to the wearer's skin must provide secondary protection and insulation against fire, flame and heat exposure which might be encountered by the wearer. As used herein, base layer garments include T-shirts, underdrawers, boxers, thermal underwear tops and bottoms, balaclavas, socks, glove liners, shirt bodies, garment panels, and inner linings for outerwear or other garment layers. Base layer garments are intended to provide protection secondary to the primary thermal protection of protective outer garments or other protective garment layers, and a critical requirement for such base layer garments is that the fabrics from which such garments are made will not deteriorate rapidly, shrink, melt, drip or adhere when exposed to elevated temperatures, consequently causing severe injury to the wearer's skin. As used herein the terms "melt" and "drip" shall correspond to the definitions provided for each in NFPA 1975 Standard, Sections 3.3.16 and 3.3.6, respectively. Accordingly, "melt" shall mean a materials response to heat evidenced by softening of the fiber polymer that results in flowing or dripping; and "drip" shall mean to run or fall in drops or blobs.

Protective apparel, like those for commercial apparel use, have historically been fashioned from a wide variety of materials including cotton, rayon, lyocell, acetate, acrylic, nylon, polyester, wool, and silk; a wide variety of flame resistant materials; and combinations of such fibrous materials. Base layers and inner linings in general have typically been made from knitted fabrics. Base layers and inner linings fashioned from one or more types of staple fibers and prepared in the form of knitted fabrics generally involve a balancing of properties. One type of fiber or fabric combination might have both desirable features and/or drawbacks which are different from other combinations of fiber and fabric types. With respect to woven fabrics, blends of nylon and cotton are known in military outerwear for high strength and abrasion resistance with longer wearlife thus increasing sustainability in combat and training (See, for example, U.S. Pat. No. 6,805,957 and PCT Published Application WO/2006/088538).

With respect to base layer garment applications, the use of cellulosic staple fibers in a knitted fabric can provide good flexibility, breathability and feel characteristics, along with some desirable thermal properties. Use of synthetic fibers, such as nylon staple fibers in knitted fabrics, can improve the strength, durability, and moisture management of such fabrics. However, the use of synthetic fibers such as polypropylene, polyester and nylon create a potential hazard when exposed to high thermal threats because they can cause severe skin injury when in molten form. In light of the special requirements for fabrics to be used in protective apparel such as base layer garments, it would be desirable to identify appropriate types of fibers and fiber blends which could be fashioned into particular types of fabrics which are especially useful for such base layers.

SUMMARY OF THE INVENTION

It has been discovered that a knit fabric exhibiting effective thermal protective characteristics, including the absence of melting or dripping, may be achieved when the fabric is comprised of an intimate blend of cellulosic and nylon staple fibers.

Such a fabric may be used to particular advantage to offer protection against severe thermal events to the wearer of a garment made from that fabric. The invention includes, in one aspect, a thermal protective knit fabric comprising yarn made from an intimate blend of cellulosic and nylon staple fibers, wherein such fabric exhibits no evidence of melting or dripping when tested in accordance with at least one of NFPA 1975 (Section 8.3), ASTM D-6413-1999 or NFPA 2112 (Section 8.2). In one embodiment, the invention may include a thermal protective knit fabric exhibiting no evidence of melting, dripping, or sticking when tested in accordance with NFPA 1975 (Section 8.3).

The fabric of the invention may comprise blended cellulosic and nylon staple yarn characterized by a weight ratio of cellulosic to nylon within said yarn ranging from about 55:45 to about 85:15.

Fabrics of the present invention may be characterized by a high level of blend uniformity in the combination of cellulose and nylon staple fibers. In a particular embodiment, the invention may include a thermal protective knit fabric comprising intimately blended yarns of cellulose and nylon staple. Suitable methods for intimately blending these yarns may include: bulk, mechanical blending of the staple fibers prior to carding; bulk mechanical blending of the staple fibers prior to and during carding; or at least two passes of draw frame blending of the staple fibers subsequent to carding and prior to yarn spinning.

One fabric of the invention may contain yarn having a ratio of cellulose to nylon within the yarn of from about 60:40 to about 70:30. Particular embodiments of the fabrics of the invention include fabrics having weights of from about 3 to about 8 oz/yd$^2$, and thicknesses of from about 0.015 to 0.030 inches. Fabrics of the invention may include those of single ply yarns having a cotton count of from about 5 to about 60.

The use of high tensile strength nylon staple can advantageously result in fabrics with exceptional durability as measured by abrasion resistance and bursting strength. Fabrics of the invention may also include those knitted from separate multiple yarns or from a plied yarn, wherein the multiple yarns or plied yarn comprises at least a first yarn made from a blend of cellulosic and nylon staple fibers in a cellulosic to nylon staple fiber ratio of from about 55:45 to about 85:15, and at least a second yarn comprised of nylon filament, provided that such nylon filament yarn does exceed 15% by weight of the total cellulosic and nylon content of the fabric; and the ratio of cellulosic to nylon staple in the first intimately blended yarn is adjusted such that the nylon filament plus staple content of the fabric does not exceed 45% by weight based on the total cellulosic and nylon content of the fabric.

The fabric of the invention may include aramid staple, with aramid staple replacing a portion of the nylon or cellulosic staple fibers in the intimate blend.

Nylon staple fibers suitable for use in fabrics of the invention include nylon 6 and/or nylon 6,6, including for example, those with tensile strength of at least 3.0 grams per denier.

BRIEF DESCRIPTION OF DRAWINGS

FIG. 1 is photograph of 60:40 weight ratio cotton to nylon fabric of the invention after undergoing a thermal stability test (six hours of exposure at 260° C.) according to the NFPA 1975 (Section 8.3) Standard.

DETAILED DESCRIPTION OF THE INVENTION

Certain yarns made from intimate blends of nylon and cellulosic staple fibers can be knit to provide fabrics particularly suitable for the manufacture of garments, having surprisingly useful combinations of properties heretofore not recognized in the garments manufacturing trade.

As used herein, the term "NYCO" shall refer to yarns that are comprised of a blend of nylon and cotton fibers. As used herein, cellulosic fibers are derived from linear long-chain polymer polysaccharide consisting of linked, beta glucose units. They include naturally occurring fibers, such as cotton, flax, hemp, jute, ramie and synthetically manufactured fibers, such as rayon (regenerated cellulose), FR (fire resistant) rayon, acetate (cellulose acetate), triacetate (cellulose triacetate), bamboo and lyocell, all of which are generic terms, well known in the art, for fibers derived from cellulose. Examples of cellulosic fibers are listed in published U.S. Patent Application 2005/0025962(A1), which is incorporated by reference as if set forth at length herein. In certain yarn and fabric embodiments of the invention, the weight percentage of the cellulosic fiber exceeds the weight percentage of nylon fiber.

Intimate blends of nylon and cellulosic staple fibers can be used to prepare yarns which in turn can be used to prepare the knit fabrics of the present invention. In one embodiment of the invention, the range of linear density of the nylon staple and the cotton staple fibers may be from about 0.90 to about 6.0 and from about 0.72 to about 2.34 denier per filament (dpf), respectively; and the range of staple length of the nylon and cotton staple fibers may be from about 1.0 to about 5.0 and from about 0.125 to about 2.5 inches, respectively. In an embodiment of the invention, the nylon staple may exhibit some degree of texturing or crimp.

When blending nylon staple fibers with cellulosic staple fibers to form yarns suitable for preparing knit fabrics in accordance with one embodiment of the invention, high tensile nylon staple fibers may be used in order for the load elongation (modulus) characteristics of the nylon and cellulosic fibers to be substantially matched. By that is meant that at the break elongation of the cellulosic with which it is blended, the nylon fibers must have an equal or superior load-bearing capacity in comparison to that of the cellulosic fiber. If the nylon fiber exhibits greater elasticity than the cellulosic fiber at the elongation characteristic of the cellulosic fiber break strength, cellulosic fiber will break before the nylon bears any substantial proportion of the load. By matching the modulus characteristics of the cellulosic and nylon fibers in this way, it is possible to provide yarns, and fabrics prepared therefrom with improved strength and durability. Processes for preparation of high tensile nylon fibers which are suitable for blending with other staple fibers such as cotton, as well as the preparation of yarns and fabrics from such blends, are disclosed in U.S. Pat. Nos. 3,044,250; 3,188,790; 3,321,448; and 3,459,845 to Hebeler et al and U.S. Pat. No. 5,011,645 to Thompson, Jr. All of these U.S. patents are incorporated herein by reference.

The high tensile nylon staple that can be used in accordance with this invention can be derived from nylon filament characterized by both a high degree of crystallinity and a high degree of crystalline orientation. These high tensile filaments can be formed by drawing them to the substantially maximum operable draw ratio and subjecting them to a heat treatment under drawing tension. Such filaments and the staples derived therefrom are commercially produced by processes similar to those described in the aforementioned patents of Hebeler et al and Thompson, Jr., as well as similar methods of manufacture in which filament rather than tow is processed. Suitable nylon polymers are the linear polyamides, such as polyhexamethylene adipamide (nylon 6,6) and polycaproamide (nylon 6). Crystallizable polyamide copolymers are also suitable when 85% or more nylon 6,6 or nylon 6 component is present. In one embodiment of the invention, the nylon used is nylon 6,6 staple. The tensile strength of the nylon 6,6 can be in the range of T=at least 5.0, e.g., 6.5 to 7.0 grams per denier (gpd). Such high tensile strengths are achievable by employing a high draw ratio, as described in the aforementioned Hebeler et al and Thompson, Jr. patents and compare to tensile strengths in the range of 3-4 gpd for standard nylon 6,6 yarns.

Nylon and cellulosic staple fiber may be blended and spun into yarn, from which the fabric of this invention may be knit. The yarns may be spun using commonly known short and long staple spinning methods including ring spinning, air jet or vortex spinning, open end spinning, and worsted or woolen spinning. Fabrics may be knit from the yarns described herein using conventional warp and weft knitting machines. For example, fabrics may be economically produced on conventional circular knitting machines. The blended yarns so employed are those which provide fabrics knitted therefrom that have a weight ratio of cellulosic fiber to nylon which ranges from about 55:45 to about 85:15. In one particular embodiment, the weight ratio of cellulose to nylon in the knit fabrics herein ranges from about 60:40 to about 70:30.

The requisite ratio of cellulose to nylon in the fabrics herein can be provided by using single ply yarn having the above-specified cellulose:nylon ratio characteristics. For example, single ply yarns of from about 5 to about 60 cotton count may be used. Alternatively, multiple or plied yarns may be employed wherein, for example, the multiple or plied yarns comprise at least a first yarn made from a blend of cellulose and nylon staple fibers in a cellulose to nylon staple fiber ratio of from about 55:45 to about 70:30, and at least a second yarn made from at least about 60%, and as high as 100%, cellulosic staple fibers. The relative amounts of each fiber type within the fabrics herein can be determined by ASTM D-629.

Nylon filament may be incorporated into knit fabrics of the invention for the purpose of enhancing tensile strength and durability of the knit fabrics of the invention. In order to derive such benefit without compromising the no melt/no drip characteristics of the fabric, the requisite ratio of cellulose to nylon in the fabrics must be carefully controlled. Such control may be achieved by employing yarns wherein the yarn comprises at least a first yarn made from an intimate blend of cellulosic and nylon staple fibers in a cotton ratio of from about 55:45 to about 85:15, and at least a second yarn comprised of nylon filament, provided that (a) such nylon filament does not exceed 15% by weight of the total cellulosic and nylon content of the fabrics: and (b) the ratio of cellulosic to nylon filament plus staple content of the fabric does not exceed 45% by weight based on the total cellulosic and nylon content of the fabric. In one embodiment of this invention, the nylon filament yarn may comprise nylon 6 and/or nylon 6,6 having a tensile strength of at least 3.0 grams per denier.

Knit fabrics of the invention may also comprise other type of yarns prepared from other types of fibers, either in staple or filament form. These additional types of yarn can be incorporated in either the wale or the course direction and can be present to the extent that they do not detract from the functional features desired for the fabric. Such additional yarn types may be those having elastomeric, flame resistant, antimicrobial and/or antistatic performance characteristics.

In the blended cellulosic-nylon yarns used to prepare the knit fabrics of this invention, other fibers, e.g., natural fibers such as wool or silk, may be substituted for a portion of the cellulosic fibers.

An inherently flame resistant fiber may be substituted for a portion of either the cellulosic fiber or the nylon staple fiber. Inherently flame resistant fibers may be selected from the group consisting of aramid fibers, meta-aramids, para-aramids, fluoropolymers and copolymers thereof, chloropolymers, polybenzimidazole, polyimides, polyamideimides, partially oxidized polyacrylonitirles, novoloids, poly(p-pheylene sulfides, flame retardant viscose rayons, polyvinyl chloride homopolymers and copolymers thereof, polyetherketones, polyketones, polyetherimides, polylactides, melamine fibers, or combinations thereof. One example of a commercial inherently flame resistant staple fiber that may be incorporated into the yarns of this invention is NOMEX® brand meta-aramid fiber available from E. I. du Pont de Nemours and Company. In one embodiment of this invention, a fabric of the invention may include a core spun yarn comprised of a continuous filament flame resistant core (e.g., NOMEX®) wrapped with a nylon/cotton staple blend of the type described herein. Other commercially available meta-aramid fibers that may be used include CONEX® and APYEIL® produced by Teijin, Ltd. and Unitika Ltd., respectively. Examples of commercially available para-aramides that may be used include KEVLAR® from E. i. du Pont de Nemours and Company and TWARONO® from Teijin Ltd. Other fire resistant fibers may also be used.

Suitable antimicrobial yarns that may be incorporated into the knit fabrics of the invention are considered to be those yarns treated in such a way as to retard the growth of microbes, such as bacteria, molds and fungi. A variety of antimicrobial compounds, both organic and inorganic may be used.

Organic antimicrobial for use in textiles include, but are not limited to, triclosan, quaternary ammonium compounds, diammonium ring compounds, chitosans, and N-halamine siloxanes. Organic compounds depend upon the antimicrobial agent to leach or migrate from inside the fiber to the surface, with antimicrobial efficiency determined by the rate of migration to the surface.

Inorganic antimicrobials are also available for use in textiles. Such compounds depend upon the disassociation of the metal from the complex to which it is bound within the polymer. The incorporation of metals such as silver, copper, mercury, and zinc into fibers and the yarns and fabrics made therefrom are well known for imparting antimicrobial functionality. Silver is a generally safe and effective antimicrobial metal and is widely used. It's incorporation into fibers by numerous methods is well known. For example Japanese Patent No. 3-136649 discloses an antibacterial cloth in which the $Ag^+$ ions in $AgNO_3$ are crosslinked with polyacrylonitirile. Japanese Patent No. 54-151669 discloses a fiber treated with an evenly coated solution containing a compound of copper and silver. U.S. Pat. No. 4,525,410 discloses fibers that are packed with specific zeolite particles having a bactericidal metal ion. U.S. Pat. No. 5,180,402 discloses a dyed synthetic fiber containing a silver-substituted zeolite and a substantially water-insoluble copper compound. The synthetic fiber is prepared by incorporating a silver-substituted zeolite in a monolayer or a polymerization mixture before the completion of polymerization in the step of preparing a polymer for the fiber. Commercially available silver zeolite complexes are currently sold by Milliken Chemical as ALPASAN® and Agion Technologies as AGION®. U.S. Pat. No. 5,897,673 discloses fibers with fine metallic particles contained therein. U.S. Pat. No. 6,979,491 discloses an antimicrobial yarn having nanosize silver particles adhered thereto and which exhibits effectiveness over a broad spectrum of bacteria, fungi, and virus. The above examples of antimicrobial agents are meant to be illustrative of additives that may be incorporated into the knit fabrics of this invention and/or the yarns or certain classes of constituent fibers comprising such yarns. These examples are not intended to be limiting, and it is anticipated that other additives providing the same antimicrobial functionality, but not explicitly mentioned, would also be suitable for use.

Suitable antistatic yarns that may be incorporated into the knit fabrics of the invention are considered to be those yarns within which electrically conductive elements are incorporated thereby imparting antistatic properties. Conductive yarns that may be used can be of a core/sheath construction, wherein either the core or the sheath represent the conductive element, biconstituent yarns comprised of conductive and non-conductive fibers (either in staple or filament form) and coated fiber (either staple or filament) or yarn. Often the conductive element chosen is carbon. U.S. Pat. No. 4,085,182 describes a process for making sheath/core filaments in which the filament has a conductive core. Sometimes it is desirable to ply one or more conductive filaments with non-conductive filaments to provide support to the conductive filament. Such a plied yarn is known as a supported yarn. French Pat. Publication No. 2466517 appears to show co-extrusion of conductive filaments with non-conductive filaments. Insertion of conductive filaments into non-conductive yarn is known. Previously spun and wound conductive filament may be combined with one or more freshly spun, non-conductive filaments to make bulked continuous filament yarn which is anti-static. Exemplary are U.S. Pat. No. 4,612,150 and U.S. Pat. No. 4,997,712. U.S. Pat. No. 5,308,563 discloses a process for producing a conductive supported yarn including the steps of melt spinning non-conductive nylon filaments to form a first set of filaments, separating at least one of the filaments into a second set of filaments, providing the second set of filaments to a suffusion coating process to apply a conductive coating, and recombining the first and second set to form a supported yarn. These examples are not intended to be limiting, and it is anticipated that other types of conductive yarns not explicitly mentioned would also be suitable for use.

An example of a class of fibers which exhibit both antimicrobial and antistatic properties is X-Static®, available from Noble Biomaterials, Inc. This material has a layer of silver bonded to the surface of a textile fiber such as nylon. Core-sheath fibers in which the core is carbon and the sheath is nylon will also impart antistatic properties and may likewise be incorporated into knit fabrics of the present invention.

Suitable elastomeric yarns for incorporation into the knit fabrics of this invention include LYCRA® brand elastane fiber available from INVISTA. As used herein, elastomeric yarns mean yarns comprised of staple or continuous fiber which has a break elongation in excess of 100% independent of any crimp and which when stretched and released, retracts quickly and forcibly to substantially its original length.

The invention includes fabrics ranging in basis weight from about 3 to 8 oz/yd$^2$. For shirting fabrics, suitable basis weights may range from about 3 to 6 oz/yd$^2$ and may range in thickness from about 0.015 to 0.030 inch. Fabric basis weight can be determined using the procedures of ASTM D-3776. Fabric thickness can be determined using the procedures of ASTM D-1777.

The knit fabrics of this invention are constructed from yarns that are comprised of intimate blends of cellulosic and nylon staple fibers. Achieving the combination of thermal properties claimed for the fabrics described herein is dependent upon an adequate level of blending. In one embodiment, yarn characterized by sufficiently intimate blends of cellulosic and nylon staple fibers may be obtained by bulk, mechanical blending of the staple by well known methods prior to carding and yarn spinning operations, or by bulk mechanical blending of the staple fibers prior to and during carding but prior to yarn spinning.

In another embodiment, a sufficiently well blended yarn may be obtained by blending the staple by use of draw frame blending subsequent to separately carding the cellulosic and nylon staple, respectively. In this method of yarn preparation, multiple ends of both cellulosic and nylon carded sliver are attenuated through sequential sets of calendar or nip rolls. As the staple fibers within each sliver are accelerated through each set of nip rolls, individual fibers are grabbed and separated from the individual starting ends and combined into the new common end. This extraction and recombination of individual staple fibers results in a drawn single end wherein the constituent staple fibers are, to some extent, randomized. The level of blending achieved in this way is lower than that obtained by bulk, mechanical blending of staple, but blend uniformity adequate to achieve the combination of thermal properties of the claimed fabrics may be achieved by employing multiple passes through a draw frame. Thus, a first pass may combine four cellulosic and four nylon ends into a single drawn end, while a second pass may combine eight blended first pass ends into a further drawn and blended single end.

As used herein, an intimate blend of cellulosic and nylon staple will refer to such staple that is either bulk mechanically blended prior to carding, or prior to and including carding, or to cellulosic and nylon staple that, subsequent to separate carding but prior to yarn spinning, is subjected to two or more passes of draw frame blending.

Topical treatments or treatments can also be applied to knit fabrics of the invention. These topical treatments or treatments can be incorporated to the extent that they do not detract from the functional features desired for the fabric; for example, chemical additives such as softeners, wicking agents, or stain release chemicals should be hydrophilic in nature if the objective is to maintain or enhance moisture management characteristics. Such additional topical treatments or treatments may be added for different functional properties and may be those having antimicrobial, antistatic, insecticidal, wrinkle resistance, flame resistance, stain release, stain repellency, oil repellency, water repellency, moisture absorbency, moisture wicking, drying efficiency, and/or hydrophobic performance characteristics.

Knit fabrics of the invention may be prepared so as to possess a combination of thermal protective properties. Such properties can be characterized and quantified using a number of different testing procedures as set forth in various ASTM and NFPA standard tests hereinafter described.

Both nylon 6,6 and polyester have the equivalent melting temperatures of 260 deg C. However, the Nylon 6,6 fiber requires 1.38 times more heat energy than polyester fibers to start the melting reaction. The molecular structure of polymers, such as polyester, break down when exposed to high temperatures. As the molecular structure becomes smaller, the polyester polymer melts, flows, and drips quickly. This is evident in 100% polyester fabrics and fiber blends containing polyester. When polyester is blended intimately with cotton, the resulting mass does melt and adhere to surfaces in direct contact. 100% nylon fabrics will also melt, drip and adhere.

During various thermal testing methods, fabric compositions of the invention exhibited surprising thermal behavior, as evidenced by visual observation, in that the composite fabric structure of the intimate blend with nylon and cotton and the resulting mass had a "no melt" appearance. While not intending to be bound by any particular theory, it is believed that nylon fibers absorb thermal energy when exposed to high temperatures. The nylon polymer molecular structure may increase in molecular weight and form cross-linkages. The cross-linking reaction to high temperature may cause the nylon fibers to harden and form gels. When intimately blended or in intimate contact, the nylon fiber may form gels and may form a carbonaceous char around the cellulosic fibers. The cellulosic fibers may char and carbonize inside the nylon carbonaceous char and may form an entirely new structure that does not deteriorate rapidly, shrink, melt, or adhere to the wearer's skin.

Thermal energy is absorbed in gel formation, charring, and carbonization. Embodiments of the invention include fabrics showing no evidence of molten behavior and demonstrating good thermal insulation as measured by ASTM and NFPA tests. In such an embodiment, the fabric during the thermal testing does not show molten drips either as would be evident in fabrics made from 100% or predominantly thermoplastic meltable fibers like nylon or polyester.

Thermal protective knit fabrics of this invention, for example, may exhibit certain Thermal Protective Performance (TPP) characteristics when tested in accordance with NFPA 2112 (Section 8.2). In one embodiment, fabrics of the invention may exhibit a Fabric Efficiency Factor (FFF) value of at least 2.0 (cal/cm$^2$)/(oz/yd$^2$) when tested in accordance with Thermal Protective Performance as cited in NFPA 2112 (Section 8.2) with a ¼" spacer and may exhibit a Fabric Efficiency Factor (FFF) value of at least 1.0 (cal/cm$^2$)/(oz/yd$^2$) when tested in accordance with Thermal Protective Performance as cited in NFPA 2112 (Section 8.2) without a spacer.

Thermal protective fabrics of the invention may exhibit no melt and no drip and easy layer separation when tested for thermal stability as cited in NFPA 1975 (Section 8.3). Fabrics which exhibit no melt or drip when exposed to flame or heat are especially desirable for use in garments such as T-shirts because this characteristic reduces the likelihood or severity of burns that can result from molten materials.

Thermal protective knit fabrics of this invention may exhibit certain thermal shrinkage characteristics when tested in accordance with NFPA 1975 (Section 8.2). In particular, the fabrics may exhibit thermal shrinkage of less than about 10% in both the wale and course directions. In one embodiment, the thermal shrinkage is less than about 8%. In another embodiment, the thermal shrinkage is less than about 6%.

In one embodiment, knit fabrics of the invention can be prepared so as to possess certain additional functional properties relating to their suitable use in protective apparel such as T-shirts. Such additional functional properties can also be characterized and quantified using several different testing procedures as set forth in various additional ASTM standard tests or other tests also hereinafter described. For example, embodiments of the invention may exhibit certain desirable abrasion resistance, bursting strength and moisture management (for example, drying time, vertical and planar wicking and absorbency) characteristics.

The construction of the knit base layer garment fabric can be adjusted to achieve certain levels of performance and comfort. In one embodiment, the cotton/nylon ratio is kept within the recommended limits in the knit fabric construction so as to maintain its desirable thermal resistance properties. Some of the construction parameters that can be adjusted for comfort and performance include desired fabric weight, yarn count, stitch length, type of stitch, wales and courses per inch, and tightness factor etc. The factors affecting comfort include moisture transport properties, i.e. air permeability and moisture vapor transmission rate (MVTR), vertical wicking, planar wicking, absorbency time, stretch and dimensional stability, merely to name a few factors.

With respect to abrasion resistance, the knit fabrics of this invention may exhibit certain abrasion resistance properties when tested in accordance with ASTM D-4966 using a Martindale Abrasion tester. In particular, the fabrics herein may exhibit Martindale Abrasion resistance of greater than about 100,000 cycles. In certain embodiments of this invention the Martindale Abrasion resistance can be demonstrated to be greater than about 300,000 cycles.

With respect to bursting strength, knit fabrics of this invention may exhibit certain bursting strength values when tested in accordance with ASTM D-3787. Fabrics of the invention may exhibit bursting strength values of at least about 60 pounds, for example, from about 70 to about 130 pounds.

With respect to drying time, knit fabrics of the invention may exhibit certain drying performance when tested in accordance with Drying Efficiency testing procedure hereinafter set forth. In particular, the knit fabrics herein may exhibit (30-minute) Drying Efficiency values of at least about 70%, for example from about 80% to 90%.

With respect to time to absorb moisture, the knit fabrics of the invention may exhibit certain absorbent performance when tested in accordance with Moisture Absorbency test procedures set forth herein. The time the knit fabric takes to absorb moisture is an indication of how quickly the knit fabric will absorb sweat away from the skin. In particular, the knit fabrics herein may exhibit absorbency times of less than 15 seconds, more preferably less than 5 seconds.

With respect to planar area across which moisture wicks, the knit fabrics of the invention may exhibit certain wicking performance when tested in accordance with the Planar Wicking test procedures set forth herein. The planar wicking area is an indication of the area across which the knit fabric spreads moisture for evaporation. In particular, the knit fabrics herein may exhibit planar wicking area of greater than 2.5 square inches, more preferably greater than 4 square inches.

With respect to vertical wicking height across which moisture wicks, the knit fabrics of the invention may exhibit certain wicking performance when tested in accordance with the Vertical Wicking test procedures set forth herein. The time to reach specific vertical wicking heights is an indication of the rate at which the knit fabric spreads moisture across the fabric surface for evaporation. In particular, the knit fabrics herein may exhibit maximum vertical wicking height of 6 inches within 30 minutes, more preferably in about 10 minutes.

Using the fabric of this invention, a garment of warp or weft knit may be manufactured from constructions such as a plain knit, knit with float stitches, knit with tuck stitches, rib knit, terry knit (full or partial cushion), interlock knit, purl knit, jacquard knit, flat knit, tricot knit, Milanese knit, or a raschel knit. Such fabrics knitted from blended yarns comprising nylon (and preferably high tensile nylon) staple fibers and companion cellulose staple fibers may provide the characteristics attributable to the cellulose fibers without deleterious effect resulting from incorporation of the nylon staple. When such fabrics comprise the relatively high amounts of cellulose compared to nylon as set forth herein, such fabrics may possess a surprisingly desirable combination of moisture management, abrasion resistance and thermal protective properties which makes such fabrics especially suitable for use in apparel such as T-shirts.

Test Methods

The test methods used to define various compositional, structural and functional characteristics and features of the knit fabrics of the present invention are summarized as follows: When ASTM or NFPA test methods are identified by numerical designation herein, the official description of each such test as provided by the American Society for Testing and Materials or the National Fire Protection Association is incorporated herein by reference.

Structure/Composition Tests

A) Fabric Weight—ASTM D-3776

Weight or basis weight of the knitted fabric is determined by weighing samples of known area and calculating weight or basis weight in terms of oz/yd$^2$ in accordance with the procedures of this standard test method.

B) Fabric Thickness—ASTM D-1777

Fabric thickness is determined by measuring the distance from one fabric surface to the opposite fabric surface with the fabric sample under standard confining pressure in accordance with the procedures of this standard test method.

C) Fiber Blend Ratio—ASTM D-629

This test method covers procedures for the determination of the fiber blend composition of mixtures of a number of types of fibers including cotton and nylon.

Functional Tests (Mechanical and Thermal Properties)

A) Abrasion Resistance—ASTM D-4966

This test involves use of a "Martindale Abrasion Tester". This device is designed to give a controlled amount of multidirectional abrasion between a fabric surface and a crossbred wool abradant fabric at comparatively low pressure until yarn breakdown or unacceptable change in color or appearance occurs.

B) Bursting Strength—ASTM D-3787

This test measures the force required to burst a knit fabric. A material specimen is clamped over a diaphragm that is inflated until the specimen bursts. The burst strength is the pressure at which the fabric bursts. Burst strength is a measure of how easily a knit fabric can be penetrated by a hard round object. Higher burst strength indicates fabrics that are more resistant to bursting.

C) Drying Efficiency

To determine drying time, conditioned samples are weighed using a lab balance, accurate to 0.001 g. The fabric specimen is removed from the balance pan and one drop of water is placed on the balance pan and weighed. The fabric specimen is then placed on the balance pan on top of and in contact with the water. After two minutes, the wet fabric specimen is weighed to obtain the wet weight, and re-weighings are repeated at two minute intervals for a total test time of thirty minutes. If the balance is equipped with an enclosure, the doors to the enclosure are kept open during the entire test. At the conclusion of the test the overall drying efficiency is calculated as the percentage of water which has left the wet sample after 30 minutes of drying time.

D) Moisture Absorbency Test—Modified AATCC 79-2000

Absorbency is a measure of the propensity of a fabric to take in water. A prescribed amount of water from a measured pipette is dropped upon the fabric from a fixed height onto a fabric mounted in an embroidery hoop with the fabric back facing outward. AATCC 79 is modified by using a fixed volume of water of 0.2 mL (0.2 cc) and a drop height of 5 cm (approximately 2 in). The drop is determined to be absorbed when there is no observable puddle or sheen on the fabric surface. The time required for the drop to be absorbed is noted as the absorbency time (seconds). Absorbency time is indication of the ability of the fabric to absorb sweat.

E) Planar Wicking Test—Modified AATCC 79-2000

The area across which a fabric can spread water is an indication of the area available for evaporation and drying. An additional measurement is obtained using modified Absorbency Test AATCC 79-2000 described above in Functional Test (D) and defined as the planar wicking area. After the water has been absorbed by the fabric and the time from when the water is applied reaches 1 minute, the nominal wet area (major axis×minor axis) is measured and recorded as the planar wicking area (square inches). The planar wicking area is an indication of the area that the fabric can spread the moisture across and the area available for evaporation.

F) Vertical Wicking Test

The vertical wicking test is used to determine the wicking height and wicking time at specified heights to assess the moisture management performance that garments made with the fabric tested may be expected to exhibit during different levels of physical activity and environmental conditions. Fabrics are conditioned before testing according to a modified version of ASTM D1776 at 21° C. and 65% relative humidity for a minimum of 16 hours. A fabric specimen 1×9 in with the long dimension corresponding to the machine direction is suspended vertically and hung with a clamp. The free end of the fabric specimen is weighted placed into distilled water so that 2.5 in of fabric are submerged for one hour. At specified time intervals, the height of the water that travels up the fabric specimen is measured and recorded. Total wicking height is measured as the maximum height attainable in one hour. The test water is discarded between samples and new, clean beaker with fresh distilled water is used for each new sample.

G) Vertical Flame Test—ASTM D-6413-1999

This test determines whether a fabric will ignite and continue to burn after exposure to an ignition source and is used to determine if a fabric is flammable. The test method sets criteria as to how the test should be conducted by specifying sample size, number of trials, type of flame, etc. The fabric is place into a holder that is suspended vertically over a high methane fueled flame for 12 seconds. Measurements made as part of the test include values for the time the fabric continues to burn after the flame source is removed (After Flame in seconds); the length of time the fabric continues to glow after the flames extinguish (After Glow in seconds); the length of the fabric that was damaged (Char Length in inches); and the observation of melting and dripping behavior.

H) Thermal Protective Performance (TPP)—NFPA 2112 (Section 8.2)

This test measures the amount of thermal protection a fabric would provide a wearer in the event of a flash fire. The TPP rating is defined as the energy required to cause the onset of a second degree burn to human tissue when a person is wearing the fabric. In the TPP test, a combined radiant and convective heat source is directed at a section of the fabric test specimen mounted in a horizontal position at a specified heat flux (typically 2 cal/cm$^2$/sec). The test measures the transmitted heat energy from the source through the specimen using a copper slug calorimeter. The TPP test can be run either with a ¼" spacer or with no space between the fabric and copper slug calorimeter. The test endpoint is characterized by the time (TPP Time) required to attain a predicted second-degree skin burn injury using a simplified model developed by Stoll & Chianta, "Transactions New York Academy Science", 1971, 33 p 649. The value assigned to a specimen in this test, denoted as the TPP rating, computed by multiplying the imposed heat flux times the test end-point time is the total heat energy that the specimen can withstand before a second degree burn is expected. Higher TPP ratings denote better insulation performance.

I) Thermal Shrinkage—NFPA 1975 (Section 8.2)

Thermal shrinkage tests examines how the garment material will react when exposed to high temperatures and if the garment will shrink substantially or could adhere to the wearer's skin. The fabric specimens are placed in an oven and are suspended by metal hooks at the top. They are exposed to a test temperature of 500° F. (260° C.) for 5 minutes. Immediately after exposure, the specimen is removed from the oven and examined for evidence of melting, dripping, separation, or ignition. The percent change in the width and length dimensions of each specimen are calculated and the results reported as the average of three specimens in each direction. Thermal shrinkage greater than 10 percent can contribute to burn injury severity due to increased heat transfer, restriction of body movement, or the breaking open of fabric.

J) Thermal Stability—NFPA 1975 (Section 8.3)

The fabric specimens are folded in half; pressed between two glass plates with a weight on the top; and are placed in a oven at 500° F. (260° C.) for six hours. Following the six hour exposure, the folded fabric between the glass plates are removed from the oven and allowed to cool. The fabric is then removed from the glass plates and observations of material deterioration, melting and softening are made. These tests evaluate how the garment material reacts to the high heat that could occur during a flash fire and if the garment could stick to the wearer's skin. NFPA 1975 (Section 8.3) requires that the fabric sample layers not stick to each other or to the glass, and that the fabric not show evidence of melting or ignition.

K) High Temperature Automatic Home Laundering of Knit and Woven Fabrics—Modified AATCC 135-2000

This method is modified for performance property testing that is dependent on fabric surface characteristics and designed to remove residual detergent that can build up artificially under laboratory conditions. Modifications to AATCC 135-2000 (Table I (1,V,Aiii)) that were employed included: (i) the use of less detergent in order to reduce residual detergent build-up; (ii) separate washings, without detergent, of a ballast of similar material type as the fabric specimen prior to laundering, periodically, and prior to the final laundering in order to remove residual chemicals; and (iii) conducting the final laundering without detergent/sour/softeners. Each knit fabric sample was placed into a standard washing machine and washed per normal machine cycle using 140° F. water temperature and AATCC Standard Detergent 124, rinsed using 105° F. water and placed into a standard dryer after final spin. The dryer setting used was tumble dry on permanent press setting. Six cycles of laundering and drying, the sixth laundering without detergent, were conducted. All moisture management tests (Moisture Absorbency, Planar Wicking, Vertical Wicking, and Drying Efficiency) were conducted using this procedure.

EXAMPLES

The following examples illustrate but do not limit the invention. The particularly advantageous features of the invention may be seen in contrast to the comparative examples, which do not possess the distinguishing characteristics of the invention.

Fabrics were knitted using conventional knit constructions as shown below and then subjected to various testing and evaluated for thermal performance. Such fabrics were prepared as follows:

A 30 s/1 (30 cotton count, 1 ply) yarn was made with three different intimate blend ratios of nominal 50/50, 40/60, and 30/70 nylon/cotton staple fibers using a conventional yarn spinning method. (Cotton count is the conventional yarn numbering system and is based on a unit length of 840 yards, and the count of the yarn is equal to number of 840-yard skeins required to weigh one pound. Under this system, the higher the number, the finer is the yarn. A skein is a continuous strand of yarn in the form of a collapsed coil. It is wound on a reel, the circumference of which usually 45-60 inches.) Yarns were spun from bulk, mechanically blended staple of cotton and synthetic fiber. A 1.7 dpf, Type 420 nylon staple fiber was used in these blends and was commercially obtained through the INVISTA™ S.à.r.l., Three Little Falls Center, 2801 Centerville Road, Wilmington, Del. USA 19808.

Three different blend fabrics were made in a simple jersey construction using a circular knitting machine. The blend fabrics were made from the blend ratio of nylon/cotton as described above. The knitted fabric details are listed below:

Loop length: 0.105 inch
Wales per inch (wpi): 32
Courses per inch (cpi): 53
Fabric weight (oz/yd$^2$): 3.65

The fabrics were bleached, scoured and then union dyed to a "sand" color using a two-step dyeing procedure. The cotton portion was dyed first using fiber-reactive Procion® dyes obtained through the Huntsman Chemical. The nylon portion was dyed second using the Lanaset® acid dyes. After rinsing with water, the dyed goods were then treated with a hydrophilic fabric softener. This dyeing procedure can also be accomplished in a one-step dyeing method. The dyed knitted fabric was then finished on a tenter frame at a temperature of 340° F. for 2 min. The nylon/cotton blend fabrics may be subjected to an additional compacting step. Finished fabric weight for all three blend fabrics was nominally in the range of 3.80 oz/yd$^2$ to 5.2 oz/yd$^2$.

A description of the fiber contents and the melt and drip characteristics of the various fabrics evaluated via several different thermal property tests are presented and summarized in Table 1.

50% cotton/50% nylon (Comparative Sample A), 60% cotton/40% nylon (Example 1), and 70% cotton/30% nylon (Example 2) all showed no evidence of melting or dripping in three of the thermal property tests: Vertical Flammability, Thermal Protective Performance, and Thermal Shrinkage. Of the cotton/nylon blends evaluated, only the 60% cotton/40% nylon (Example 1) and 70% cotton/30% nylon (Example 2) delivered acceptable performance in the most discerning test, Thermal Stability, which is specifically designed to determine the potential for materials to adhere to the wearer's skin. Neither of these blends revealed any visual evidence of melting or dripping, nor did either stick to the glass or to itself as illustrated after exposure in the thermal stability test in FIG. 1. In contrast, the blend with 50% nylon content (Comparative Example A) was found to be unacceptable. The 100% nylon sample (Comparative Example E) showed clear visual evidence of melting. While the 50% (Comparative Example A) did not appear to show obvious signs of melting and it did not firmly adhere to the glass or itself, the fabric layers did not separate easily, and there was evidence of softening as determined by microscopic examination.

By way of comparison, a 100% polyester fabric (Comparative Example D) and a 50% cotton/50% polyester fabric (Comparative Example B) were also evaluated (both summarized in Table 1). Both showed unacceptable behavior in that the 100% polyester sample melted, and both stuck to the glass and to themselves. It was also not possible to separate the fabric layers for either example containing polyester. Thus, it is clear that the same level of protection for a wearer's skin against melting and dripping as afforded by cotton/nylon blends cannot be cannot be achieved by substitution of the nylon by an equivalent amount of polyester.

Table 2 presents the results of a set of comparative examples in which knit fabrics of similar construction to those characterized in Table 1 were prepared, except that a standard nylon filament yarn and a cotton yarn were knitted in side-by-side fashion rather than using blended yarns. Details of the knit constructions employed are included in Table 2. The results for Comparative Examples E-I demonstrate that the equivalent no melt/no drip behavior achieved with intimately blended NYCO yarns of 30% and 40% nylon (Examples 1 and 2 of Table 1, respectively) could only be approached at nylon contents of less than 15% (Comparative Example I) in the case of non-blended yarns. The results of Table 1 and 2 together clearly indicate the critical importance of using yarn prepared from an intimate blend of the constituent fibers.

Table 3 presents the thermal protective properties of the same cotton/nylon fabrics that are described in Table 1

(Examples 1 and 2 and Comparative Example A), a lighter weight cotton/nylon fabric (Example 3), and commercially available 100% polyester, cotton, and flame resistant T-shirt fabric (Comparative Examples D and J-L) as measured in the Thermal Protective Performance test with a ¼ inch spacer between the fabric specimen and the copper calorimeter as tested in accordance with NFPA 2112 (Section 8.2). Thermal insulation of NYCO blends is excellent with comparable TPP ratings to 100% cotton knit (Comparative Example J) and NOMEX® knit (Comparative Example K) and clearly superior to poor TPP ratings attained by 100% polyester knit (Comparative Example D) and FR modacrylic blend knit (Comparative Example L). The Fabric Efficiency Factor (FFF) value divides the TTP rating by the fabric weight as comparison of a material's thermal protective efficiency. FFF values are on the order of 100% cotton (Comparative Example E) and NOMEX® knit (Comparative Example F) with FFF values above 2.0 (cal/cm$^2$)(oz/yd$^2$). FFF values are also clearly superior to 100% polyester knit (Comparative Example D) and FR modacrylic blend knit (Comparative Example L) which are less than 1.0 (cal/cm$^2$)/(oz/yd$^2$). In addition to absence of melting and dripping, the knits of this invention perform with comparable efficiency to known commercial knits demonstrating excellent thermal insulation and are superior to some of the commercial FR knits available.

The Thermal Protective Performance test in accordance with NFPA 2112 (Section 8.2) can be run in two configurations with and without a ¼ inch spacer. In the configuration discussed above, a ¼ inch spacer is placed between the fabric sample and the heat sensor to simulate the normal fit of clothing as well as to allow the fabric to reach as high a temperature as would occur in an actual flame exposure. When the Thermal Protective Performance test is run with the ¼ inch spacer configuration, the material specimen is surrounded by air and absorbs the full heat energy of the test exposure. The configuration with the ¼ inch spacer represents the most challenging test conditions for evaluation of the thermal insulative performance of different materials and the integrity of fabrics under thermal load. When the Thermal Protective Performance test is run without the ¼ inch spacer configuration, the material specimen is in contact with the copper calorimeter that can act as a heat sink and pull heat energy away from the material specimen and delay the material response with the heat energy exposure. The configuration without the ¼ inch spacer is useful in assessing the fabric integrity and behavior of innermost layer which could be in direct contact with the skin.

Table 4 presents the thermal protective properties of the same cotton/nylon fabric described in Table 1 (Example 1), lighter weight 50% cotton/50% nylon fabric (Example 3 and Comparative Example O), and commercially available 85% polyester/15% cotton, 100% polyester, cotton and flame resistant T-shirt fabrics (Comparative Examples C, D, and J-N) as measured in the Thermal Protective Performance test without a ¼ inch spacer between the fabric specimen and the copper calorimeter as tested in accordance with NFPA 2112 (Section 8.2). Thermal insulation of NYCO blends is acceptable with TPP ratings in the range of 100% cotton knit (Comparative Example J) and NOMEX® knit (Comparative Example K), and higher than the TPP ratings attained by 100% polyester knit (Comparative Example D) and FR modacrylic blend knits (Comparative Example L-N). The Fabric Efficiency Factor (FFF) value divides the TTP rating by the fabric weight as comparison of a material's thermal protective efficiency. FFF values when tested in the configuration without the ¼ inch spacer tend to be directly related to fabric weight, thus a FFF rating above 1.0 is acceptable. FFF values for the NYCO knits are above 1.0 (cal/cm$^2$)/(oz/yd$^2$) and thus are acceptable. The 100% cotton (Comparative Example J) and NOMEX® knit (Comparative Example K) with FFF values also above 1.0 (cal/cm$^2$)/(oz/yd$^2$). By contrast, the FFF values for 100% polyester knit (Comparative Example D) and FR modacrylic blend knits (Comparative Example L-N) are less than 1.0 (cal/cm$^2$)/(oz/yd$^2$). The NYCO knits, 100% cotton (Comparative Example J) and NOMEX® knit (Comparative Example K) all maintain their fabric integrity and do not break open during the thermal exposure. By contrast, 100% polyester knit (Comparative Example D) melts and breaks open and FR modacrylic blend knits (Comparative Example L-N) disintegrate and break open upon thermal exposure. The higher FFF values for NYCO knits, 100% cotton (Comparative Example J) and NOMEX® knit (Comparative Example K) are reflective of maintaining fabric integrity upon thermal loading. The lower FFF values for 100% polyester knit (Comparative Example D) and FR modacrylic blend knits (Comparative Example L-N) are reflective of the lack of fabric integrity upon thermal loading. In addition to absence of melting and dripping, the knits of this invention perform with comparable efficiency to known commercial knits demonstrating excellent thermal insulative performance and maintaining fabric integrity, and are higher in performance to 100% polyester and some of the commercial FR knits available.

Table 5 presents the thermal shrinkage properties of the same cotton/nylon fabrics that are described in Table 1 (Examples 1 and 2 and Comparative Example A), a lighter weight cotton/nylon fabric (Example 3) and commercially available 50% polyester/50% cotton, 100% polyester, cotton and flame resistant T-shirt fabrics (Comparative Examples B-D, and J-N) as measured in the Thermal Shrinkage test as tested in accordance with NFPA 1975 (Section 8.2). Thermal shrinkage of NYCO blends is excellent with shrinkage about and under 6% and well under the 10% maximum requirement. 100% Cotton knit (Comparative Example J) and NOMEX® knit (Comparative Example K) also exhibit low shrinkage with high thermal exposure. While the FR modacrylic blend knits (Comparative Example L-N) exhibit extremely high shrinkage. In addition to absence of melting and dripping, the knits of this invention have excellent thermal shrinkage performance and are comparable to known commercial knits demonstrating excellent thermal performance and are superior to some of the commercial FR knits available.

Achieving acceptable melt/drip and thermal protective behavior does not impose any minimum nylon content on the fabric blend. However, other performance characteristics such as fabric strength, abrasion resistance, and moisture management which may required in order to satisfy military specifications or consumer preferences can be achieved by adding nylon to the fabric blend as demonstrated in Tables 6 and 7.

Table 6 shows the effect on burst strength of adding high tensile strength nylon to a fabric blend. Burst strength is shown to increase as the amount of high tensile strength nylon is increased in the blend (Example 2, Example 1, Comparative Example A). Burst strength data was normalized to account for fabric weight differences. Comparing normalized burst strength results of synthetic fiber/cotton or inherent FR fiber blends to high tensile strength nylon blends show a 15.8 to 100% increase in strength. In comparison to commercially available cotton blend and FR knits, the knits of this invention attain a high strength to weight ratio enabling lighter weight fabrics with burst strengths well above the acceptable level of 60 lbs.

Abrasion resistance data can be used to predict wear performance of a fabric. As the amount of high tensile strength nylon is added to the fabric blend, the abrasion resistance increases (Example 2, Example 1, Comparative Example A). Abrasion resistance of other synthetic blends commonly used in knit fabrics (such as polyester or inherent FR fibers such as modacrylic) is significantly lower versus similar weight fabrics containing high tensile strength nylon (Example 3 versus Comparative Example B, Example 1 versus Comparative Examples L, M, N, P). Lower weight fabrics with higher normalized burst strength and abrasion resistance can be constructed using high tensile strength nylon versus heavier weight 100% cotton, 50% polyester/50% cotton and modacrylic blend fabrics (Example 3 versus Comparative Examples B, P, L, M). Even with light fabric weights, the knits of this invention achieve abrasion resistance well over 100,000 cycles.

Moisture management performance is related to resulting fabric comfort and is characterized by measuring vertical and planar wicking, absorbency, and drying efficiency. All fabrics with results listed in Table 7 were laundered 5 times per AATCC 135 Table 1 (1,V,A,iii) with one additional laundering cycle without detergent. The additional cycle was run to remove any residual detergent on the fabric which may affect wicking and absorbency results.

As illustrated in Table 7, the absorbency time for a measured drop of water to absorb into a fabric is very fast (1 second) for all the cotton/nylon fabrics. All comparative examples without any nylon content have much slower absorbency times. The same trend is also seen with planar wicking. Planar wicking is the area in the fabric that absorbed the measured water droplet and spread the water across the fabric surface. Again, all comparative examples without any nylon content shown in Table 7 have lower wicking area. The knits of this invention exhibit absorbency times well under 15 seconds and well over 2.5 inches in planar wicking area.

Table 7 shows the vertical wicking rate at which water will spread vertically up the same cotton/nylon knit fabrics that are described in Table 1 (Examples 1 and 2 and Comparative Example A), a lighter weight cotton/nylon fabric (Example 3) and commercially available 50% polyester/50% cotton, cotton and flame resistant T-shirt fabrics (Comparative Examples B, P, L and M). The faster the wicking rate, the faster water spreads across the fabric and is available to evaporate from the fabric surface. The vertical wicking height of cotton/nylon fabrics (Examples 1-3 and Comparative Example A) all reach the full sample height of 6 inches at 10 minutes. All comparative examples (Comparative Examples B, P, L and M) without any nylon content show substantially lower wicking rates and do not reach the full wicking weight even after 60 minutes. The knits of this invention exhibit vertical wicking times well under 30 minutes to reach the full 6 inch fabric sample height.

Drying Efficiency or how quickly a fabric will dry after absorbing sweat or moisture is a very important test for fabric comfort. As seen in Table 7, drying efficiency increases as nylon content is increased for similar fabrics weights/constructions (Example 2, Example 1, Comparative Example A). The lower weight, nylon containing fabric (Example 3) shows the impact of higher nylon content plus fabric weight with more open knit construction. All comparative examples without nylon have lower drying efficiency/drying rate. The knits of this invention exhibit drying efficiencies well over 70% after 30 minutes.

TABLE I

| | | | | Vertical Flammability | | Thermal Protective Performance | | | |
|---|---|---|---|---|---|---|---|---|---|
| | | | Fabric Weight | ASTM 6413-99 Material Observations | | per NFPA 2112 no spacer Material Observations | | per NFPA 2112 with spacer Material Observations | |
| | Fiber Blend | Blend Ratio | (oz/yd2) | Melt | Drip | Melt | Drip | Melt | Drip |
| Comparative Example A | Cotton:Nylon | 50:50 | 4.8 | no, charred | none | no, charred | no | no, charred | no |
| Example 1 | Cotton:Nylon | 60:40 | 4.9 | no, charred | none | no, charred | no | no, charred | no |
| Example 2 | Cotton:Nylon | 70:30 | 4.7 | no, charred | none | no, charred | no | no, charred | no |
| Comparative Example E | Nylon | 100 | 5.0 | yes | yes | yes, broke open | yes | yes, broke open | yes |
| Comparative Example B | Cotton:Polyester | 50:50 | 4.3 | no | no | no | no | no | no |
| Comparative Example D | Polyester | 100 | 5.2 | yes | yes | yes, broke open | yes | yes, broke open | yes |

| | Thermal Shrinkage per NFPA 1975 (Chapter 8.2) Material Observations | | | | | Thermal Stability per NFPA 1975 (Chapter 8.3) Material Observations | | | | |
|---|---|---|---|---|---|---|---|---|---|---|
| | Pass or Fail | Melt | Drip | Separate | Ignite | Pass or Fail | Melt | Ignite | Stick to Itself | Stick to Glass |
| Comparative Example A | Pass | no | no | no | no | Fail | no | no | yes | no |
| Example 1 | Pass | no | no | no | no | Pass | no | no | no | no |
| Example 2 | Pass | no | no | no | no | Pass | no | no | no | no |
| Comparative Example E | Fail | no | no | no | no | Fail | yes | no | yes | yes |

TABLE I-continued

| | | | | | | | | | | |
|---|---|---|---|---|---|---|---|---|---|---|
| Comparative Example B | Pass | no | no | no | no | Fail | yes | no | yes | yes |
| Comparative Example D | Fail | no | no | no | no | Fail | yes | no | yes | yes |

TABLE 2

| | Fabric Knit Construction | | | | | Thermal Stability as cited in NFPA 1975 (Chapter 8.3) Material Observations | | | | |
|---|---|---|---|---|---|---|---|---|---|---|
| | Fiber Blend | Blend Ratio | Fabric Weight (oz/yd$^2$) | Cotton Yarn Size Cotton Count | Nylon Filament Size (denier) | Pass or Fail | Melt | Ignite | Stick to Itself | Stick to Glass |
| Comparative Example E | Nylon | 100 | 5 | NA | 140 | Fail | yes | no | yes | yes |
| Comparative Example F | Cotton:Nylon | 57:43 | 5.6 | 40 | 100 | Fail | yes | no | yes | no |
| Comparative Example G | Cotton:Nylon | 72:28 | 5.7 | 30 | 70 | Fail | yes | no | yes | no |
| Comparative Example H | Cotton:Nylon | 79:21 | 6.7 | 20 | 70 | Fail | no | no | yes | no |
| Comparative Example I | Cotton:Nylon | 87:13 | 6.4 | 20 | 40 | Pass | no | no | no | no |

TABLE 3

| | | | | Thermal Protective Performance per NFPA 2112 with spacer | | | | |
|---|---|---|---|---|---|---|---|---|
| | Fiber Blend | Blend Ratio | Fabric Weight (oz/yd$^2$) | TPP Time (seconds) | TPP Rating (cal/cm$^2$) | FFF Value (cal/cm2)/(oz/yd$^2$) | Material Observations Melt | Drip |
| Comparative Example A | Cotton:Nylon | 50:50 | 4.8 | 5.5 | 11.0 | 2.3 | no, charred | no |
| Example 1 | Cotton:Nylon | 60:40 | 4.9 | 6.3 | 12.5 | 2.5 | no, charred | no |
| Example 3 | Cotton:Nylon | 60:40 | 3.9 | 4.6 | 9.1 | 2.4 | no, charred | no |
| Example 2 | Cotton:Nylon | 70:30 | 4.7 | 6.9 | 13.7 | 2.8 | no, charred | no |
| Comparative Example J | Cotton | 100 | 4.5 | 6.4 | 12.8 | 2.8 | no, charred | no |
| Comparative Example D | Polyester | 100 | 5.2 | 2.4 | 4.8 | 0.9 | yes, broke open | yes |
| Comparative Example K | NOMEX ®:KEVLAR ®:P140 | 92:5:3 | 6.3 | 7.4 | 14.8 | 2.3 | no, charred | no |
| Comparative Example L | FR-modacrylic:polyester:spandex:X-Static | 75:10:10:5 | 5.1 | 2.4 | 4.7 | 0.9 | no, broke open | no |

TABLE 4

| | | | | Thermal Protective Performance per NFPA 2112 without spacer | | | | |
|---|---|---|---|---|---|---|---|---|
| | Fiber Blend | Blend Ratio | Fabric Weight (oz/yd$^2$) | TPP Time (seconds) | TPP Rating (cal/cm$^2$) | FFF Value (cal/cm$^2$)/(oz/yd$^2$) | Material Observations Melt | Drip |
| Comparative Example O | Cotton:Nylon | 50:50 | 4.5 | 4.9 | 9.8 | 2.2 | no, charred | no |
| Example 1 | Cotton:Nylon | 60:40 | 4.9 | 5.6 | 11.2 | 2.3 | no, charred | no |
| Example 3 | Cotton:Nylon | 60:40 | 3.9 | 4.8 | 9.5 | 2.5 | no, charred | no |
| Comparative Example D | Polyester | 100 | 5.2 | 2.2 | 4.4 | 0.8 | yes | yes |
| Comparative Example C | Polyester:Cotton | 85:15 | 6.2 | 3.5 | 6.9 | 1.1 | yes | yes |
| Comparative Example J | Cotton | 100 | 4.5 | 5.5 | 10.9 | 2.4 | no, charred | no |

TABLE 4-continued

| | | | | Thermal Protective Performance per NFPA 2112 without spacer | | | | |
|---|---|---|---|---|---|---|---|---|
| | Fiber Blend | Blend Ratio | Fabric Weight (oz/yd$^2$) | TPP Time (seconds) | TPP Rating (cal/cm$^2$) | FFF Value (cal/cm$^2$)/ (oz/yd$^2$) | Material Observations Melt | Material Observations Drip |
| Comparative Example K | NOMEX ®:KEVLAR ®:P140 | 92:5:3 | 6.3 | 5.1 | 10.2 | 1.6 | no, charred | no |
| Comparative Example L | FR-modacrylic:polyester:spandex:X-Static | 75:10:10:5 | 5.1 | 2.6 | 5.2 | 1.0 | no, broke open | no |
| Comparative Example M | FR-modacrylic:TENCEL ® rayon | 85:15 | 4.9 | 3.7 | 7.4 | 1.5 | no, broke open | no |
| Comparative Example N | FR-modacylic:FR rayon | 78:22 | 5.9 | 4.0 | 8.0 | 1.4 | no, broke open | no |

TABLE 5

| | | | | Thermal Shrinkage per NFPA 1975 (Chapter 8.2) | | | | | | |
|---|---|---|---|---|---|---|---|---|---|---|
| | | | | | | Material Observations | | | | |
| | Fiber Blend | Blend Ratio | Fabric Weight (oz/yd$^2$) | Wales (%) | Course (%) | Pass or Fail | Melt | Drip | Separate | Ignite |
| Comparative Example A | Cotton:Nylon | 50:50 | 4.8 | 6 | 3.9 | Pass | no | no | no | no |
| Example 1 | Cotton:Nylon | 60:40 | 4.9 | 2.3 | 3.4 | Pass | no | no | no | no |
| Example 3 | Cotton:Nylon | 60:40 | 3.9 | 2.1 | 1.3 | Pass | no | no | no | no |
| Example 2 | Cotton:Nylon | 70:30 | 4.7 | 3.1 | 1.8 | Pass | no | no | no | no |
| Comparative Example E | Nylon | 100 | 5.0 | 5.0 | 1.6 | Pass | no | no | no | no |
| Comparative Example B | Cotton:Polyester | 50:50 | 4.3 | 6 | 2.5 | Pass | no | no | no | no |
| Comparative Example C | Polyester:Cotton | 85:15 | 6.2 | 5.4 | 5.5 | Pass | no | no | no | no |
| Comparative Example D | Polyester | 100 | 5.2 | 19.9 | 11.1 | Fail | no | no | no | no |
| Comparative Example J | Cotton | 100 | 4.5 | 1.3 | 0.8 | Pass | no | no | no | no |
| Comparative Example K | NOMEX ®:KEVLAR ®:P140 | 95:5:3 | 6.3 | 1 | 1.6 | pass | no | no | no | no |
| Comparative Example L | FR-modacrylic:polyester:spandex:X-Static | 75:10:10:5 | 4.7 | 43.6 | 37.2 | Fail | no | no | no | no |
| Comparative Example M | FR-modacrylic:TENCEL ® rayon | 85:15 | 4.9 | 25.7 | 26.1 | Fail | no | no | no | no |
| Comparative Example N | FR-modacrylic:FR rayon | 78:22 | 5.9 | 57.6 | 49.5 | Fail | no | no | no | no |

TABLE 6

| | | | | Physical Property Evaluation | | |
|---|---|---|---|---|---|---|
| | Fiber Blend | Blend Ratio | Fabric Weight (oz/yd$^2$) | Burst Strength (lbs) | Strength by Fabric Weight (lbs/(oz/yd$^2$)) | Resistance (ASTM D4966 - 9 kpa) (# cycles to failure) |
| Comparative Example A | Cotton:Nylon | 50:50 | 4.8 | 109.2 | 22.8 | 550,000+ |
| Example 1 | Cotton:Nylon | 60:40 | 4.9 | 99.2 | 20.2 | 550,000+ |
| Example 3 | Cotton:Nylon | 60:40 | 3.9 | 73.24 | 19.0 | 141,062 |
| Example 2 | Cotton:Nylon | 70.30 | 4.7 | 94.2 | 20.0 | 176,338 |
| Comparative Example B | Cotton:Polyester | 50:50 | 4.3 | 70.5 | 16.4 | 57,971 |
| Comparative Example P | Cotton | 100 | 5.7 | 83.6 | 14.7 | 34,333 |
| Comparative Example L | FR-modacrylic:polyester:spandex:X-Static | 75:10:10:5 | 5.1 | 58.2 | 11.4 | 83,497 |
| Comparative Example M | FR-modacrylic:TENCEL ® rayon | 85:15 | 4.9 | 70.2 | 14.3 | 10,575 |
| Comparative Example N | FR-modacrylic:FR rayon | 78:22 | 5.9 | 94.6 | 16.0 | 4,289 |

TABLE 7

| | Fiber Blend | Blend Ratio | Fabric Weight (oz/yd$^2$) | Moisture Management Performance After 6 high temperature home launderings (AATTCC 135 1VAiii) Absorbency (seconds) | Planar Wicking Area (in$^2$) | Drying Efficiency after 30 minutes (% dry) | Vertical Wicking Height at 10 minutes (in) | Vertical Wicking Height at 30 minutes (in) | Time to reach 6 inch Wicking Height (minutes) |
|---|---|---|---|---|---|---|---|---|---|
| Comparative Example A | Cotton:Nylon | 50:50 | 4.8 | 1.0 | 5.2 | 89.9 | 6.0 | 6.0 | 10 |
| Example 1 | Cotton:Nylon | 60:40 | 4.9 | 1.0 | 4.6 | 87.1 | 6.0 | 6.0 | 10 |
| Example 3 | Cotton:Nylon | 60:40 | 3.9 | 1.0 | 4.6 | 97.5 | 6.0 | 6.0 | 10 |
| Example 2 | Cotton:Nylon | 70:30 | 4.7 | 1.0 | 4.6 | 84.6 | 6.0 | 6.0 | 10 |
| Comparative Example B | Cotton:Polyester | 50:50 | 4.3 | 16.8 | 2.1 | 54.1 | 3.3 | 5.3 | 40 |
| Comparative Example P | Cotton | 100 | 5.7 | 7.0 | 2.1 | 36.7 | 3.7 | 5.3 | 52 |
| Comparative Example L | FR-modacrylic:polyester:spandex:X-Static | 75:10:10:5 | 5.1 | Did not absorb | 0.0 | 54.1 | 0.0 | 0.0 | Does not wick |
| Comparative Example M | modacrylic:TENCEL ® rayon | 85:15 | 4.9 | 70.2 | 1.9 | 79.9 | 1.1 | 2.9 | Greater than 60 minutes |

What is claimed is:

1. A thermal protective knit fabric comprising yarn made from an intimate blend of cellulosic fibers and nylon staple fibers, wherein nylon staple fibers have equal or superior load-bearing capacity in comparison to said cellulosic fibers, further wherein said fabric exhibits thickness in the range from about 0.015 to 0.030 inches, exhibits a Martindale Abrasion Resistance of at least about 100,000 cycles when tested in accordance with ASTM D-4966, and exhibits no evidence of melting or dripping or softening or sticking to glass or to itself after exposure to thermal stability test when tested in accordance with at least one of NFPA 1975 (Sections 8.2 and 8.3), ASTMD-6413-1999 or NFPA 2112 (Section 8.2); wherein the blended cellulosic and nylon staple yarn includes a weight ratio of cellulosic to nylon within said yarn ranging from about 60:40 to about 70:30, wherein said fabric has a weight of from about 3 to about 8 oz/yd2 and further wherein said intimate blend is characterized by a blend uniformity achievable by blending methods chosen from the group consisting of a) bulk mechanical blending of the stable fibers prior to carding;

b) bulk mechanical blending of the stable fibers prior to and during carding; and c) at least two passes of draw frame blending of the staple fibers subsequent to carding and prior to yarn spinning.

2. A thermal protective knit fabric according to claim 1 wherein the yarn used to form the knit fabric is a single ply yarn having a cotton count of from about 5 to about 60.

3. A thermal protective knit fabric according to claim 1 wherein a) said knit is knitted from separate multiple yarns or from a plied yarn;

b) said multiple yarns or plied yarn comprises at least a first yarn made from an intimate blend of cellulosic and nylon staple fibers in a cellulosic to nylon staple fiber ratio of from about 60:40 to about 70:30, and at least a second yarn comprised of nylon filament, provided that such nylon filament yarn does exceed 15% by weight of the total cellulosic and nylon content of the fabric; and c) the ratio of cellulosic to nylon staple in the first intimately blended yarn is adjusted such that the nylon filament plus staple content of the fabric does not exceed 45% by weight based on the total cellulosic and nylon content of the fabric.

4. A thermal protective knit fabric according to claim 1 wherein a) said fabric is knitted from separate multiple yarns or from a plied yarn;

b) said multiple yarns or plied yarn comprises at least a first yarn made from an intimate blend of cellulosic and nylon staple fibers in a cellulosic to nylon staple fiber ratio of from about 60:40 to about 70:30 and at least a second yarn made from an intimate blend of cellulosic and nylon staple fibers in a cellulosic to nylon staple fiber ratio of at least about 60:40, and at least a third nylon filament yarn provided that such nylon filament yarn does exceed 15% by weight of the total cellulosic and nylon content of the fabric.

5. A thermal protective knit fabric according to claim 1 wherein a portion of the cellulosic staple fibers in said intimate blend is replaced with wool or silk and/or a portion of the cellulosic and/or nylon staple fibers in said intimate blend is replaced with fire-resistant staple fibers.

6. A thermal protective knit fabric according to claim 1 wherein said nylon staple fibers comprise nylon 6 and/or nylon 6,6 and have a tensile strength of at least 3.0 grams per denier.

7. A thermal protective knit fabric according to claim 1 wherein said fabric comprises a knit construction selected from plain knit, knit with tuck and/or float stitches, rib knit, jacquard knit, interlock knit, tricot knit, and raschel knit.

8. A thermal protective knit fabric according to claim 1 wherein said fabric comprises yarns made from fibers or filaments which have elastomeric, flame-resistant, antimicrobial and/or antistatic characteristics.

9. A thermal protective knit fabric according to claim 1 wherein said fabric has applied to it a topical treatment or treatments which will impart to the fabric antimicrobial, antistatic, insecticidal, wrinkle resistance, flame resistance, stain release, stain repellency, oil repellency, water repellency, moisture absorbency, moisture wicking, drying efficiency, and/or hydrophobic characteristics.

10. A thermal protective fabric according to claim 1 which exhibits a Fabric Efficiency Factor (FFF) value of at least 1.0

(cal/cm2)/(oz/yd2) when tested in accordance with Thermal NFPA 2112 (Section 8.2) without a spacer.

11. A thermal protective fabric according to claim 1 which exhibits a Fabric Efficiency Factor (FFF) value of at least 2.0 (cal/cm2)/(oz/yd2) when tested in accordance with NFPA 2112 (Section 8.2) with a ¼ inch spacer.

12. A thermal protective knit fabric according to claim 8 wherein such fabric exhibits no evidence of melting, dripping, or sticking when tested in accordance with NFPA 1975 (Section 8.3).

13. A thermal protective knit fabric according to claim 1 wherein the thermal shrinkage of such fabric is less than about 8% in both the wale and course directions when tested in accordance with NFPA 1975 (Section 8.2).

14. A thermal protective knit fabric according to claim 1 which exhibits a ball bursting strength of at least about 60 pounds when tested in accordance with ASTM D-3787.

15. A thermal protective knit fabric according to claim 1 which exhibits a Drying Efficiency of at least about 70%.

16. A thermal protective knit fabric according to claim 1 which exhibits an absorbency time of less than 15 seconds.

17. A thermal protective knit fabric according to claim 1 which exhibits a planar wicking area of greater than 2.5 square inches.

18. A thermal protective knit fabric according to claim 1 which exhibits a vertical wicking height of 6 inches in less than 10 minutes.

19. An article of apparel which comprises a thermal protective knit fabric according to claim 1.

20. An article of apparel in the form of a base layer garment which comprises a thermal protective knit fabric according to claim 1.

21. A base layer garment in the form of a T-shirt which comprises a thermal protective knit fabric according to claim 1.

22. A thermal protective knit fabric comprising cellulosic and nylon staple yarn characterized by a weight ratio of cellulosic to nylon within said yarn ranging from about 60:40 to about 70:30, wherein at least a portion of said knit fabric forms a non-flowing structure at temperatures above the melting point of the nylon and wherein said knit fabric exhibits a Martindale Abrasion Resistance of at least about 100,000 cycles when tested in accordance with ASTM D-4966.

23. The thermal protective knit fabric of claim 22, wherein said cellulose is cotton.

24. A thermal protective system comprising:

a) a first layer of a knit fabric containing yarn comprising an intimate blend of cellulosic and nylon staple fibers, wherein such fabric is characterized as no-melt or no-drip when tested in accordance with at least one of NFPA 1975 (Sections 8.2 and 83), ASTMD-6413-1999 or NFPA 2112 (Section 8.2) and exhibits a Martindale Abrasion Resistance of at least about 100,000 cycles when tested in accordance with ASTM D-4966; and b) a second layer of woven fabric comprising blended yarn containing cellulosic staple fiber and nylon staple fiber, wherein said blended yarn is characterized by a weight ratio of cellulosic to nylon within said yarn ranging from about 60:40 to about 70:30.

25. A thermal protective system comprising:

a) a first layer of a knit fabric containing yarn comprising an intimate blend of cellulosic and nylon staple fibers, wherein such fabric is characterized as no-melt or no-drip when tested in accordance with at least one of NFPA 1975 (Sections 8.2 and 8.3), ASTM D-6413-1999 or NFPA 2112 (Section 8.2) and exhibits a Martindale Abrasion Resistance of at least about 100,000 cycles when tested in accordance with ASTM D-4966;

b) a second layer comprising woven fabric containing yarn selected from the group consisting of: (i) blended yarn containing cellulosic staple fiber and nylon staple fiber, wherein said blended yarn is characterized by a weight ratio of cellulosic to nylon within said yarn ranging from about 60:40 to about 70:30; and (ii) fire-resistant yarn containing aramid staple fiber.

26. A method of making a thermal protective knit fabric comprising the steps of:

a) providing yarn made from an intimate blend of cellulosic and nylon staple fibers;

b) knitting said yarn to form fabric wherein such fabric exhibits no evidence of melting of melting or dripping when tested in accordance with at least one of NFPA 1975 (Sections 8.2 and 8.3), ASTM D-6413-1999 or NFPA 2112 (Section 8.2) and exhibits a Martindale Abrasion Resistance of at least about 100,000 cycles when tested in accordance with ASTM D-4966; wherein the blended cellulosic and nylon staple yarn includes a weight ratio of cellulosic to nylon within said yarn ranging from about 60:40 to about 70:30.

27. The method of claim 26 further comprising cutting said thermal protective knit fabric to form component parts of a garment.

28. A method of making a thermal protective garment comprising the steps of:

a) providing thermal protective knit fabric comprising yarn made from an intimate blend of cellulosic and nylon staple fibers, wherein such fabric exhibits no evidence of melting of melting or dripping when tested in accordance with at least one of NFPA 1975 (Sections 8.2 and 8.3), ASTM D-6413-1999 or NFPA 2112 (Section 8.2) and exhibits a Martindale Abrasion Resistance of at least about 100,000 cycles when tested in accordance with ASTM D-4966; and b) assembling said thermal protective knit fabric to provide a garment.

29. The method of claim 28 wherein said assembling step comprises sewing.

* * * * *